US009765476B2

(12) United States Patent
Tang et al.

(10) Patent No.: US 9,765,476 B2
(45) Date of Patent: Sep. 19, 2017

(54) TREATMENT PLATE FOR A GARMENT TREATMENT APPLIANCE

(71) Applicant: KONINKLIJKE PHILIPS N.V., Eindhoven (NL)

(72) Inventors: Jiecong Tang, Eindhoven (NL); Ytsen Wielstra, Eindhoven (NL); Ya Ling Lee, Eindhoven (NL); Sabrina May Fong Khoo, Eindhoven (NL); Lihong Zhao, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/764,015

(22) PCT Filed: Jan. 23, 2014

(86) PCT No.: PCT/EP2014/051281
§ 371 (c)(1),
(2) Date: Jul. 28, 2015

(87) PCT Pub. No.: WO2014/122023
PCT Pub. Date: Aug. 14, 2014

(65) Prior Publication Data

US 2016/0017536 A1 Jan. 21, 2016

Related U.S. Application Data

(60) Provisional application No. 61/761,348, filed on Feb. 6, 2013.

(30) Foreign Application Priority Data

Apr. 2, 2013 (EP) ..... 13161937

(51) Int. Cl.
*D06F 75/38* (2006.01)
*B05D 1/02* (2006.01)
*B05D 3/00* (2006.01)

(52) U.S. Cl.
CPC ..... *D06F 75/38* (2013.01); *B05D 1/02* (2013.01); *B05D 3/00* (2013.01); *B05D 3/007* (2013.01)

(58) Field of Classification Search
CPC ..... D06F 75/00; D06F 75/30; D06F 75/38; B05D 1/02; B05D 3/00; B05D 3/10; B05D 7/00; B05D 3/007
See application file for complete search history.

(56) References Cited

U.S. PATENT DOCUMENTS 4,665,637 A 5/1987 Kramer
5,592,765 A 1/1997 Oomen
(Continued)

FOREIGN PATENT DOCUMENTS

CN 1205039 A 1/1999
EP 0510546 A1 10/1992
(Continued)

OTHER PUBLICATIONS

Kazutaka Kamitani, "Development of Water-Repellent Glass Improved Water-Sliding Property and Durablitity", Journal of Sol-Gel Science and Tecnology 26, 823-825, 2003.
(Continued)

*Primary Examiner* — Ismael Izaguirre

(57) ABSTRACT

The invention relates to a treatment plate (10) for a garment treatment appliance (100) for treating garments (30), which plate has a contact surface which is provided with a sol-gel coating (20) that comprises an oxide of titanium, zirconium, hafnium, scandium, yttrium, or a mixture or combination thereof. The layer preferably has a thickness of less than 1
(Continued)

μm. Such a layer shows excellent properties. A garment treatment appliance comprising such a treatment plate, as well as processes to produce the coating on the contact surface of the treatment plate are also disclosed.

13 Claims, 3 Drawing Sheets

(56) References Cited

U.S. PATENT DOCUMENTS 5,718,753 A * 2/1998 Suzuki ..... B82Y 30/00 106/403
5,943,799 A 8/1999 Xu
6,000,157 A * 12/1999 De Beurs ..... D06F 75/38 38/93
6,582,506 B2 * 6/2003 Archambeault ..... C09C 1/62 106/218
7,040,047 B2 5/2006 Boulud
7,339,142 B2 3/2008 Pessayre
7,456,121 B2 * 11/2008 Comte ..... C03C 1/004 501/4
9,562,316 B2 2/2017 Tang
2002/0053562 A1 * 5/2002 Cuillery ..... H05B 3/262 219/254
2003/0177672 A1 * 9/2003 Lukas ..... C23C 14/028 38/74
2006/0254418 A1 11/2006 Barbezat
2010/0055475 A1 * 3/2010 Verschuuren ..... B44C 1/24 428/447
2010/0107457 A1 5/2010 Nathamuni Balaji
2012/0181488 A1 7/2012 Steiger
2013/0247430 A1 9/2013 Paccaud

FOREIGN PATENT DOCUMENTS

EP 0711863 A1 5/1996
WO 9701599 A1 1/1997
WO 0182652 A1 11/2001
WO 2004076570 A1 9/2004

OTHER PUBLICATIONS

IEC Standard Soleplates Smoothness, 6031 IEC:2002+A1:2005+A2:2009(E), pp. 24-25.
J.K. Lancaster, "CRC Handbook of Lubrication", vol. II, pp. 269-290.

* cited by examiner

TREATMENT PLATE FOR A GARMENT TREATMENT APPLIANCE

This application is the U.S. National Phase application under 35 U.S.C. §371 of International Application No. PCT/EP2014/051281, filed on Jan. 23, 2014, which claims the benefit of European Application No. 13161937.1 filed on Apr. 2, 2013 and U.S. Provisional Application No. 61/761,348 dated Feb. 6, 2013. These applications are hereby incorporated by reference herein.

FIELD OF THE INVENTION

The invention relates to a treatment plate for a garment treatment appliance, which treatment plate has a contact surface that in use slides on a garment being treated, which contact surface has a coating, which has, among others, a favorable gliding behavior as shown by a low friction. The invention also relates to a garment treatment appliance, comprising said treatment plate, and to methods to produce a coating on a contact surface of a treatment plate for a garment treatment appliance.

BACKGROUND OF THE INVENTION

Low friction coatings allow contacting surfaces to rub against one another with reduced friction, reducing the effort to move garment treatment appliances, like dewrinkling devices, such as an iron, or a steamer. Further, a scratch resistant coating is very important for electrical appliances, and also for non-electrical domestic appliances, such as pans, oven plates and the like, that benefit from low friction. Hence the use of a coating with low friction co-efficient and good scratch resistance, to improve the tribological properties of appliance surfaces is constantly increasing.

An example of a treatment plate for a garment treatment appliance for treating garments is the soleplate of an iron. In general, a separate layer, here referred to as a coating layer, is applied to the surface of the soleplate facing away from the housing of the iron. During ironing, this coating layer directly contacts the clothes to be ironed. A prerequisite for the proper functioning of the iron is that such a coating layer meets a large number of requirements. For example, the coating layer must, inter alia, exhibit satisfactory low friction properties on the clothes to be ironed, it must be corrosion-resistant, scratch-resistant, and durable, and exhibit an optimum hardness and high resistance to wear and to fracture. The material of the coating layer must meet extra high requirements because the coating layer is exposed to substantial variations in temperatures ranging between 10° C. and 300° C., with typical operational temperatures ranging from 70° C. to 230° C. The required gliding behavior is obtained by having a low friction providing coating on the soleplate and this reduces the effective force applied on the garment as well.

Several materials may be used as low friction soleplate coating materials for an iron, such as silicates applied via sol-gel techniques, enamel, metal (e.g. nickel, chromium, stainless steel) that may be applied, for example, as sheet material or by thermal spraying, hard anodized aluminum, and diamond-like carbon coatings. Also an organic polymer may be used as a soleplate coating, for example polytetrafluoroethylene (PTFE). The PTFE low friction coating shows good gliding and non-stick properties, however the mechanical properties like scratch and wear resistance of PTFE coating is poor.

Another type of low friction coating has been disclosed in U.S. Pat. No. 5,943,799 A1, the low friction layer consists predominantly of aluminum oxide which is formed in an electrochemical manner, and the low friction coating shows good gliding behavior, as well as good scratch resistance and easy to clean. However, the substrate used for forming of the low friction metal oxide coating has to be the same metal, which is aluminium in this case, and restricts the application of the coating.

A sol-gel coating for use on irons is disclosed in U.S. Pat. No. 5,592,765. The sol-gel coating shows good properties such as good wear and scratch resistance, as well as good stain resistance.

U.S. Pat. No. 7,339,142 discloses an iron having a soleplate covered with a coating consisting of an external layer, comprising at least one oxidation catalyst chosen among oxides of platinoids, and at least one internal layer, located between the metal support and the external layer, comprising at least one oxidation catalyst chosen among the oxides of the transition elements of group 1b. Platinoids are, in this reference, deemed to be elements having properties similar to those of platinum, in particular, in addition to platinum, ruthenium, rhodium, palladium, osmium, and iridium, thus elements of groups 8-10 of the periodic table. The coating is claimed to be self-cleaning, at the operating temperature of the device.

An iron having a soleplate with an oxidation catalyst present on the outer surface of the soleplate is known from U.S. Pat. No. 7,040,047. The catalytic oxidation agent is, according to this reference, any element, compound or composition capable of oxidizing, at a temperature at least equal to 90° C., any organic substance such as contained in the dirt, or stains, presently encountered in the treatment (including washing and possibly softening) of textile articles or pieces (for example linen). As examples of catalytic active elements, palladium, platinum, vanadium, and copper are mentioned. To increase the catalytic effectiveness, oxides of copper, manganese or cobalt can be present. The catalytically active form of the oxidation agent, for example platinum, can be obtained by calcination. This reference also mentions by way of example, that the catalytic oxidation agent comprises a metal of group IV of the periodic table; the use of these metals has nevertheless not been illustrated.

The teaching of the above references is that "organic dirt" captured by the soleplate during ironing is oxidized so that it will be detached from the soleplate. It is said that even when the soleplate is tarnished in a manner that is hardly visible, it will partially lose its sliding qualities. Imperceptibly, with the soiling, the ironing will become more difficult, while the user will become apprehensive of using a tarnished iron, fearing that it can alter the laundry.

US 2013/0247430 describes a heating appliance including a metal substrate, at least a part of which is covered with a self-cleaning coating including at least one oxidation catalyst selected from the platinoid oxides, and at least one dopant of said oxidation catalyst selected from the rare-earth oxides. The self-cleaning coating is a bilayer coating including: an inner layer at least partially covering the metal substrate and including the dopant; and an outer layer in contact with the ambient air and including the oxidation catalyst. Also provided is a method for producing such a heating appliance.

U.S. Pat. No. 4,665,637 describes a fabric pressing device having a composite sole plate with a base component of metal or similar thermally conductive material that is coupled to the heat source of the pressing iron, and a layer of ceramic bonded to the base component. The ceramic layer has a planar fabric pressing surface that preferably has a smoothness of about a nominal two micrometers surface roughness or better. That ceramic surface is highly resistant to wear and to impact, is easy to clean, and has excellent dynamic and static frictional characteristics on textile fabrics.

SUMMARY OF THE INVENTION

For interest in stain, scratch and wear resistant and consistent low friction elements of garment treatment appliances like on a garment dewrinkling device, such as an iron, or a steamer, it is important that the coating maintains consistent good gliding behavior, as well as good stain, scratch and wear resistance under extreme usage conditions, e.g. cyclical temperature changes ranging from room temperature to 250° C., frequent mechanical wearing and high steam or humidity environments.

It is an object of the invention to provide a treatment plate for a garment treatment appliance, which plate has a contact surface that in use slides on the garment being treated, and shows even further improved properties over the prior art appliances. The invention is defined by the independent claims. The dependent claims define advantageous embodiments.

The invention provides a treatment plate for a garment treatment appliance for treating garments, which treatment plate has a contact surface that in use slides on the garment being treated, and wherein said contact surface is provided with a coating that comprises a metal oxide selected from the group consisting of titanium oxide, zirconium oxide, hafnium oxide, scandium oxide, yttrium oxide, or a mixture or composition thereof.

It was surprisingly found that coatings of the mentioned metal oxides, especially sol-gel coatings, show very good and consistent gliding behavior. Applicant found that thorough cleaning of the contact plate actually increases friction and that low friction is obtained again by using (i.e. sliding) the plate on the garment. This effect is explained by the fact that organic lubricants, produced by contacting the coating, during use, with the article made of a non-metallic fabric, are retained and accumulated on the network of the produced coating, and will act as a lubricant. This is contrary to the teaching of the above-mentioned prior art documents, which teach that the "organic dirt" has to be removed (by oxidation, e.g. by a catalyst) for consistent gliding behavior. It surprisingly appeared that the coating layer, especially in combination with the (sol-gel) base layer or intermediate layer, has low friction properties on the clothes to be ironed, is corrosion-resistant, is scratch-resistant, and is durable. Further, in tests and/or in demo apparatus, the coating layer exhibited very good hardness and high resistance to wear and to fracture, even when substantially increasing the temperature.

It was further noticed that the coefficient of friction of the present coatings, which is a measure for the gliding behavior, drops almost immediately, i.e. within a few seconds, to a very low value after being brought into contact with non-metallic fabric, and will keep this low value. The low coefficient of friction of the present coatings is thus generated by using the appliance; it is not a property of the coating material itself. It is further observed that by non-metallic fabric any material is to be understood that is used for garments and linen, such a cotton, wool, silk, synthetics, like polyester, etc.

Although in general, the coefficient of friction of garment dewrinkling devices, like irons and steamers, tends to drop over time, i.e. the gliding behavior is improved, it may take many hours of usage before it stabilizes at a lower value. If the user has cleaned the coating surface, the coefficient of friction returns to the original value, and the gliding behavior worsens again, as will be explained below. The gliding behavior of the present coatings is nevertheless constantly good, and at a low value once the very first use has taken place. Even when it is tried to clean the coating with the usual cleaning agents, the low value of the coefficient of friction is obtained within seconds from the beginning of using the appliance.

Herein, the phrase "treatment plate has a contact surface that in use slides on a garment being treated" and similar phrases are used. Further, it is indicated that "said contact surface is provided with a (e.g. sol-gel) coating that comprises a metal oxide selected from the group consisting of titanium oxide, zirconium oxide, hafnium oxide, scandium oxide, yttrium oxide, or a mixture or composition thereof". Hence during use the sol-gel coating layer of the invention, that sol-gel coating layer may thus in effect slide on the garment being treated. Further coatings may not be excluded. Hence, the term "contact surface" especially refers to an outer surface of the layer most remote from the substrate on which the coating is or coatings are provided.

The coating according to the invention preferably (substantially) consists of titanium oxide, zirconium oxide, or a mixture or composition thereof, more preferably titanium oxide. Especially, the coating consists of at least 85 wt. %, even more especially at least 90 wt. %, such as especially at least 95 wt. % of titanium oxide, zirconium oxide, or a mixture or composition thereof, more preferably titanium oxide (relative to the total weight of the coating).

In yet a further specific embodiment, the coating does not comprise yttrium in an amount more than 95 wt. % relative to the total metal (atom) weight in the coating. In yet a further embodiment, the coating does not substantially consist of an yttrium oxide coating. It surprisingly experimentally appeared that substantially pure yttrium oxide coatings have less advantageous properties than e.g. pure titania coatings or a mixture or composition of titanium dioxide with one or more zirconium oxide, hafnium oxide, scandium oxide, and yttrium oxide, especially with one or more of titanium oxide, zirconium oxide, scandium oxide, and yttrium oxide. Further, especially the weight of metals like one or more of rare earth metals, manganese and cobalt, is smaller than 5 wt. %, especially smaller than 1 wt. %, even more especially smaller than 0.01 wt. %, relative to the total metal (atom) weight in the coating. Even more especially, the weight of metals like one or more manganese and cobalt, is smaller than 5 wt. %, especially smaller than 1 wt. %, even more especially smaller than 0.01 wt. %, relative to the total metal (atom) weight in the coating. It appears that the present coating have superior properties over manganese oxide coating or cobalt oxide coatings or coatings comprising one or more of manganese oxide and cobalt oxide (see also FIG. 2). Further, the coating is also especially substantially free of a platinoid (see also above). Especially, the weight a platinoid is smaller than 5 wt. %, especially smaller than 1 wt. %, even more especially smaller than 0.01 wt. %, relative to the total metal (atom) weight in the coating.

In a specific embodiment, said coating substantially consists of (i) a titanium oxide, zirconium oxide or a mixture or combination of titanium oxide and zirconium oxide, or (ii) a titanium oxide, yttrium oxide or a mixture or combination of titanium oxide and yttrium oxide.

The advantages of the metal oxide coatings, used in the invention, are that they show a low coefficient of friction, have preferably a thickness of less than 1 μm, and can be applied with a low temperature process (preferably at temperatures below 400° C.), such as a sol-gel process to obtain a sol-gel coating. They are further transparent at a more preferred thickness of less than 400 nm. Especially, the metal oxide coating has a thickness ranging from 5 nm-1 μm, especially 5 nanometers to 400 nanometers. Another favorable property of these metal oxide coatings is that the triboelectric effect during rubbing/ironing is reduced: that is, static charge built-up during rubbing/ironing is reduced; this effect is also assumed to be the result of a kind of building up of a layer of lubricating organic particles/contaminants (debris) on the coating. Further, the present coating can relatively easily be applied, such as if desired in one go. Beyond that, it is not inherently necessary to include a post polishing step after (sol-gel) application of the layer. This may for instance be necessary when a thick ceramic layer is applied like e.g. described in EP 0217014/U.S. Pat. No. 4,665,637. Herein, the term "sol-gel (coating) process" and similar terms refer to the herein described sol-gel process.

In a preferred embodiment of the invention, said metal oxide containing layer has a thickness less than 1 μm, preferable less than 400 nm to keep the transparency, and is preferably a sol-gel coating. Such a nanolayer can keep the aesthetic appearance of the substrate, and also allows the retaining of other mechanical and thermal properties of the contact surface, such as resistance to wear and fracture, and expansion coefficient.

The coating will substantially cover the entire contact surface, although it is also possible that the coating is applied in a pattern of non-contiguous portions that partly cover the entire contact surface. Hence, the coating may in embodiments especially cover at least 80%, even more especially at least 90%, such as substantially all of the (contact) surface of the treatment plate.

In a preferred embodiment of the invention, the present treatment plate comprises a substrate having said contact surface onto which said coating is applied, wherein said substrate is a metal, enamel, organic polymer, organo-silicate or silicate substrate.

In another embodiment, the treatment plate comprises a metal contact surface, and said coating is directly applied onto said metal contact surface.

According to a further embodiment, the treatment plate comprises a contact surface (preferably made of metal), and the plate further comprises at least one layer arranged between said contact surface and said coating wherein said layer is preferably a metal composition, an enamel, organic polymer, organo-silicate or silicate layer. Such a layer is also expediently a sol-gel layer. Such layer arranged between said contact surface and said coating is herein also indicated as "intermediate layer" or "intermediate coating layer" or "base layer" or "basis layer". This intermediate layer can be seen as a layer between the substrate, especially a metal substrate, and the actual gliding layer.

Therefore, in a specific embodiment the invention also provides a treatment plate for a garment treatment appliance, which treatment plate has a contact surface that in use slides on a garment being treated, wherein said contact surface is provided with a sol-gel coating that comprises a metal oxide selected from the group consisting of titanium oxide, zirconium oxide, hafnium oxide, scandium oxide, yttrium oxide, or a mixture or combination thereof, and wherein the treatment plate comprises a metal substrate and wherein the treatment plate further comprises at least one layer arranged between said metal substrate and said coating, said layer being a metal composition, an enamel, organic polymer, organo-silicate or silicate layer.

Especially, a combination of oxides relates to a layer of oxides where different oxides are mixed and it can be observed and define which regions are belonging to which oxide. No (substantial) chemical reaction between the original oxides may have taken place. Especially, a mixture (see also below) may refer to a layer where the oxides are mixed at a molecular/atomic/ionic scale where it cannot be differentiate to be a single type of oxide. A material is then obtained wherein the ions of the (original) oxides are in the same (crystalline) lattice. An example of a mixed oxide is e.g. $Y_3Al_5O_{12}$ and an example of a combination of oxides is $Y_2O_3+Al_2O_3$.

According to another embodiment, said intermediate coating layer consists of a silicate layer wherein optionally said metal oxide, selected from titanium oxide, zirconium oxide, hafnium oxide, scandium oxide, yttrium oxide, or a mixture or combination thereof, has been incorporated. Such intermediate layer may especially be obtainable by a sol-gel (coating) process. Thus, especially the intermediate coating layer when available—is applied by a sol-gel coating process, and the coating layer, such as described herein, is also applied by a sol-gel coating process (see also below).

Hence, the invention especially provides a treatment plate for a garment treatment appliance, which treatment plate has a surface with a (especially sol-gel) coating thereon, wherein the coating, especially the sol-gel coating, comprises a metal oxide, wherein the metal (of the metal oxide) comprises one or more of titanium, zirconium, hafnium, scandium, yttrium. Such metal oxide may be a (substantially) pure oxide. Such metal oxide may also be a combination of oxides, such as a mixture of titanium oxide and yttrium oxide. Such metal oxide may also be a mixed oxide. For instance, the coating can comprise a $TiO_2$ coating. However, the coating can also comprise a coating of $TiO_2$ and $Y_2O_3$ (mixed materials in the coating). Further, the coating can also be a coating of $YScO_3$, which is a mixed oxide. A mixed oxide contains cations of more than one chemical element or cations of a single element in several states of oxidation (or a combination thereof). When materials are mixed, there are substantially two or more different crystalline materials next to each other, such as in the above example $TiO_2$ and $Y_2O_3$, whereas in a mixed oxide, there is substantially one crystalline material with the cations of the mixed oxide, such as in the above example yttrium and scandium, in the same crystalline lattice. In use, one face of such coating may slide on a garment being treated (the other face may be in contact with the support, or an intermediate layer). Hence, in embodiments the term "metal oxide" may also relate to a combination of metal oxides and/or a mixed metal oxide. When mixing metal precursors from one solution, the final oxide layer obtained after application and drying may contain a mixture of metal oxides or mixed metal oxides. Furthermore, the final metal oxide layer can be crystalline, partly crystalline, or amorphous.

The invention further relates to a treatment plate which is a soleplate for an ironing appliance, to an ironing appliance comprising a treatment plate as a soleplate as disclosed above, and to a garment treatment appliance comprising a treatment plate as disclosed above. It has been found that even at low temperatures the gliding behavior of the coated treatment plate according to the present invention is excellent, thus allowing low-temperature ironing.

The invention further relates to methods to produce a coating on a contact surface of a garment treatment appliance for treating garments, wherein, in use, said contact surface slides on the garment being treated. Especially, the invention provides a method to produce a coating on a (contact) surface of a treatment plate for a garment treatment appliance, wherein, in use, said contact surface slides on a garment being treated, the method comprising the steps of:

depositing on said contact surface a layer of a precursor material of a metal or compound, selected from titanium, zirconium, hafnium, scandium, yttrium, or a mixture or combination of these metals or compounds, wherein the precursor material comprises one or more of a hydrolysable precursor and a hydrolysable precursor solution; and treating said layer to obtain a layer comprising titanium oxide, zirconium oxide, hafnium oxide, scandium oxide, yttrium oxide, or a mixture or combination thereof.

With this method, a treatment plate for a garment treatment appliance for treating garments may be provided, which treatment plate has a contact surface that in use slides on the garment being treated, and wherein said contact surface is provided with a coating that comprises a metal oxide selected from the group consisting of titanium oxide, zirconium oxide, hafnium oxide, scandium oxide, yttrium oxide, or a mixture or composition thereof. During use, said coating, such as described herein, will slide on the garment being treated. The coating may herein therefor also be indicated as "garment treatment coating" or "gliding layer".

In a first embodiment, the present method comprises the steps of depositing on said contact surface a layer of a hydrolysable precursor, preferably an alkoxide precursor or an acetate precursor, of a metal, selected from titanium, zirconium, hafnium, scandium, yttrium, or a mixture or composition of these metals or compounds, and curing said layer to obtain a layer comprising titanium oxide, zirconium oxide, hafnium oxide, scandium oxide, yttrium oxide, or a mixture or combination thereof.

Such a method may comprise the deposition of the precursor compound by means of a dry chemical process, preferably a vapor deposition process.

In a second embodiment, the present method comprises the steps of preparing a hydrolysable precursor solution, preferably of an alkoxide precursor or an acetate precursor, of a metal, selected from titanium, zirconium, hafnium, scandium or yttrium, or a mixture or combination of these metal compounds, depositing a layer of said precursor solution on said contact surface, followed by drying, if necessary, and curing to obtain a layer comprising titanium oxide, zirconium oxide, hafnium oxide, scandium oxide, yttrium oxide, or a mixture or combination thereof.

In such a method, the deposition may be effected by means of a wet chemical process, preferably a solution process, more preferably a sol-gel process.

The metal alkoxide or acetate precursors, preferably used in the invention, are (iso-)propanolate or acetylacetonate derivatives thereof (i.e. a (iso-)propanolate or acetylacetonate derivative of the alkoxide or acetate). Diketones like e.g. acetyl aceton or ethyl acetoacetate can be used to make the precursors less water sensitive. The invention is nevertheless not restricted to these precursors; other alkanolates can be used as well, also other metal salts can be used like e.g. acetates provided that they can easily be converted into the oxide form in the present process. Alkoxides may e.g. be modified by alkoxy- and aminoalcohols, β-diketones, β-ketoesters, carboxylic acids to provide metal alkoxide or metal alkoxide derivatives. Examples of suitable alkoxides and acetates are isopropopoxide, (iso-)propanolate, acetate, acetylacetonate, ethylacetoacetate, t-butylacetoacetate, etc.

The solvent used for the preparation of the precursor solution is preferably a lower alcohol, specifically ethanol, isopropyl alcohol, 2-butanol or 2-butoxy ethanol.

Drying and curing of the deposited layer of an alkoxide precursor of a metal is preferably effected at a temperature below 400° C. This layer can directly be deposited on the contact surface of the treatment plate.

In an embodiment, said contact surface of the treatment plate consists of a metal, enamel, organic polymer, organo-silicate, or silicate composition.

In a preferred embodiment of the invention, said contact surface has been precoated with at least one layer, preferably consisting of a metal composition, an enamel, an organic polymeric, organo-silicate or silicate coating, more preferably a metal oxide layer, made for example by a solgel technique. The precoated layer, i.e. the intermediate layer, may especially provide the mechanical strength and is in general at least 1 μm thick, such as in the range of 1-100 μm. The metal oxide coating (i.e. an oxide of Ti, Zr, etc.) of the invention especially provides the low friction function, and has a thickness especially of not larger than 1 μm, such as 5-400 nm. As indicated above, the intermediate layer may especially be provided by a sol-gel process.

In case of an iron, the metal oxide overcoat layer can thus be deposited on top of a sole-plate coating, which is preferably a silicate based coating, applied by a sol-gel process or by another process like PVD, CVD and thermal spraying, thus further improving the gliding behavior of the sol-gel based silicate coating. These processes are well-known to an expert. The sol-gel coating with the external metal oxide layer then shows excellent and consistent gliding behavior, while it maintains good wear, scratch, and strain resistance.

Reasons to prefer a sol-gel process for oxide layer formation are its low cost, and it is easy for industrialization. As indicated above, an advantage of sol-gel layer is it's easy for industrialization via e.g. a simple spraying process instead of vacuum process. It is further beneficial that the present coating, such as e.g. obtainable by spray-painting the metal oxide layer, such as especially the titania layer, and that the final layer needs no post polishing as is needed with e.g. plasma sprayed layers. Furthermore, the coating (or gliding layer) is transparent and not opaque as particle based coatings from the prior art. It may therefore not influence how the color of the coating is perceived. For instance, when a colored base layer is applied, or when a print is available, this may be still seen through the coating. Hereby, more design freedom is retained than in some prior art solutions where the color is e.g. the intrinsic color of the plasma sprayed layer.

Such a layer, located between the metal support of the iron and the external layer, can contain e.g. a mixture of fine metal oxide fillers and a sol such as silica sol and silanes, e.g. organically modified silanes, providing good adherence to the metal substrate as well as good mechanical properties, on which a metal oxide external layer is disposed, comprising at least an oxide of titanium, zirconium, hafnium, scandium or yttrium or mixtures or combinations thereof. Compared to a prior art systems without the outer inorganic metal oxide layer coating as defined herein r, it has excellent and more consistent gliding behavior; the coefficient of friction of the coating on fabrics, e.g. cotton, synthetics, linen and silk, is consistently a very low value. Especially, the support is a metal support. Hence, especially the support of the iron is a metal support of the iron.

The coating thus renders the appliance, e.g. an iron soleplate, an excellent and more consistent gliding behavior, good wear, scratch and stain resistant on the appliance surface and articles in contact i.e. fabrics, as will also be disclosed below.

The coating can thus be applied by a solution deposition process, such as spin-coating, dip-coating or spraying process, or by a vapour deposition process, like PVD or CVD, or by a thermal spray process. Especially, the coating of the invention is applied by a solution deposition process, such as spin-coating, dip-coating or spraying process. More especially, the deposition process comprises a sol-gel process.

In a further embodiment, the components of the above mentioned sol-gel coating are combined with the components of the metal oxide layer to produce one coating layer.

Hence, the invention also provides a method for providing a sol-gel coating on a treatment plate for a garment treatment appliance, wherein the treatment plate comprises a surface, and optionally thereon an intermediate layer, wherein the method comprises providing said sol-gel coating on the surface of the treatment plate or the optional intermediate layer, wherein this method comprises a sol-gel coating process, and wherein the sol-gel coating on the treatment plate or the optional intermediate layer comprises a metal oxide, wherein the metal of the metal oxide comprises one or more of titanium, zirconium, hafnium, scandium, yttrium. Especially, during use, said coating, such as described herein, will slide on the garment being treated. Hence, during use of the garment treatment appliance, the treatment plate may be in contact with the garment being treated and move easily over this garment with relative ease as the friction is low.

The invention also relates to a method to improve the gliding behavior of a treatment plate for a garment treatment appliance, especially a soleplate for an ironing appliance, by applying on a contact surface of said treatment plate a coating that comprises a metal oxide selected from the group consisting of titanium oxide, zirconium oxide, hafnium oxide, scandium oxide, yttrium oxide, or a mixture or combination thereof.

Further, the specific embodiments described above with respect to the coating on the contact surface of a treatment plate, especially for a garment treatment appliance, may also apply to, and may be combined with, the herein described method and method embodiments.

The main element of the present invention is thus a thin layer of metal oxide film that can be applied on top of a substrate by a sol-gel process, or by PVD, CVD or thermal spray process, especially by a sol-gel process, to improve the coating gliding performance on garment. Hence, the main element of the present invention is thus a thin layer of metal oxide film that can be applied on top of a substrate optionally already including a pre-coat (or in fact an intermediate layer) by a sol-gel process, or by PVD, CVD or thermal spray process, especially by a sol-gel process, to improve the coating gliding performance on garment. This new low friction, anti-scratch, anti-wear, and easy-clean coating with metal oxide layer offers many advantages over conventional coatings because of their excellent and consistent gliding behavior, as well as stain, scratch and wear resistant properties.

Especially, a treatment plate is provided with a stack of layers, with a base layer and the gliding layer or coating as described herein. The base layer is directed to the treatment plate, and may even be in contact with the treatment plate. Especially, the gliding layer or coating in use slides on a garment being treated. In between the base layer and the gliding layer or coating, there may be optionally further layers. Optionally, a print may be available between the base layer and the coating layer or gliding layer. Especially, most of the layers of the stack are sol-gel coatings. For instance, the print may be a silicone based material. Hence, in an embodiment all layers, except for the optional print may be sol-gel layers.

These and other aspects of the invention will be apparent from and elucidated with reference to the embodiments described hereinafter.

BRIEF DESCRIPTION OF THE DRAWINGS

These and other aspects, features and advantages of the present invention will be further explained by the following description of one or more preferred embodiments, with reference to the drawings, in which.

DETAILED DESCRIPTION OF THE INVENTION

The invention will be better understood by reading the examples hereafter and the annexed drawings.

Figure 1:
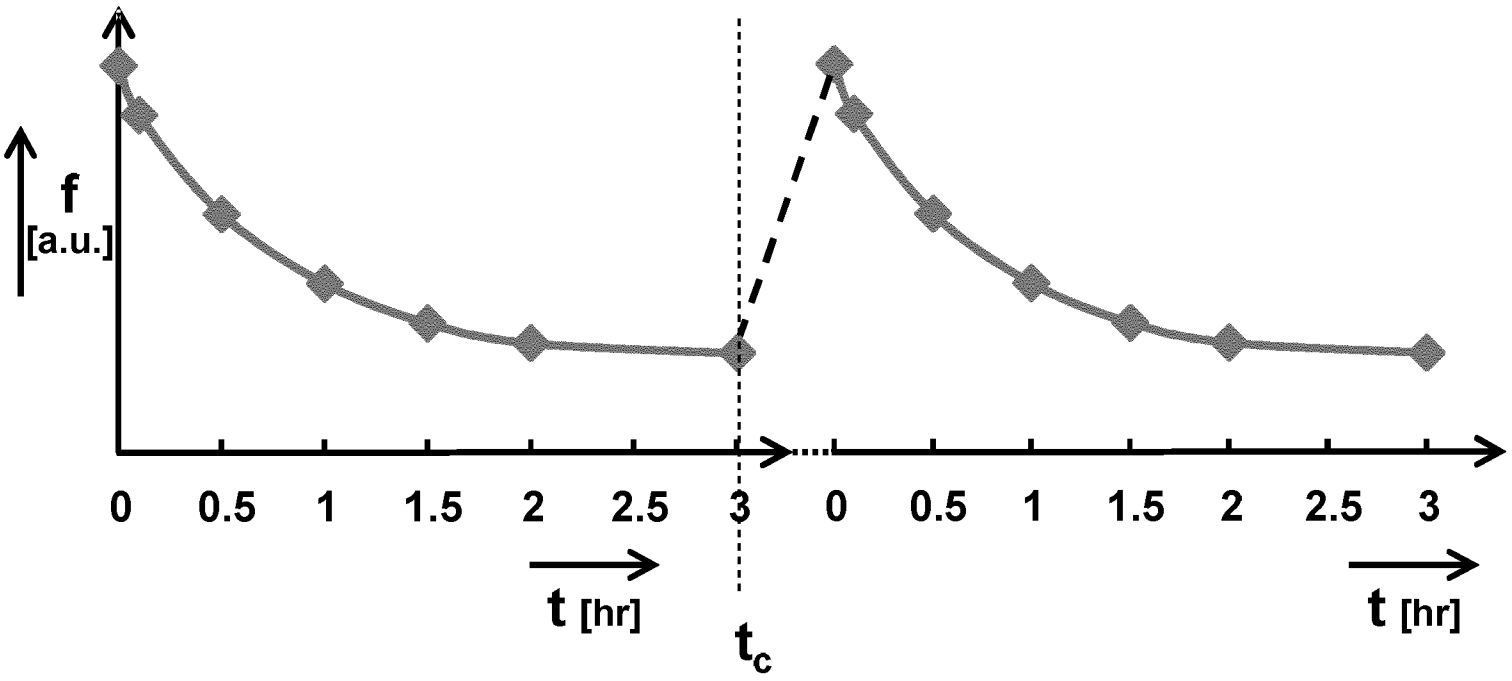
FIG. 1 is a diagram showing the gliding reversible effect over the ironing time of a prior art contact surface.

Referring to FIG. 1, there is shown the coefficient of friction f (vertical axis, in arbitrary units) as a function of the ironing time t (horizontal axis, in hours), by using an iron having a contact surface without a metal oxide layer according to the invention. The right-hand half of this drawing specifically illustrates the effect of cleaning the contact surface.

In general for most coatings, the coefficient of friction f of a garment dewrinkling device, such as a steamer or an iron, tends to drop over time, i.e. the gliding behavior is improved, as is shown in this diagram.

However, it may take many hours of usage before it stabilizes at a lower value. If the user cleans the coating surface (at time $t_c$), the coefficient of friction f returns to the original value (as shown by the dotted line), causing gliding behavior to deteriorate again. It takes several hours of usage before they stabilize at the lower value, as indicated in the right half of FIG. 1.

Figure 2:
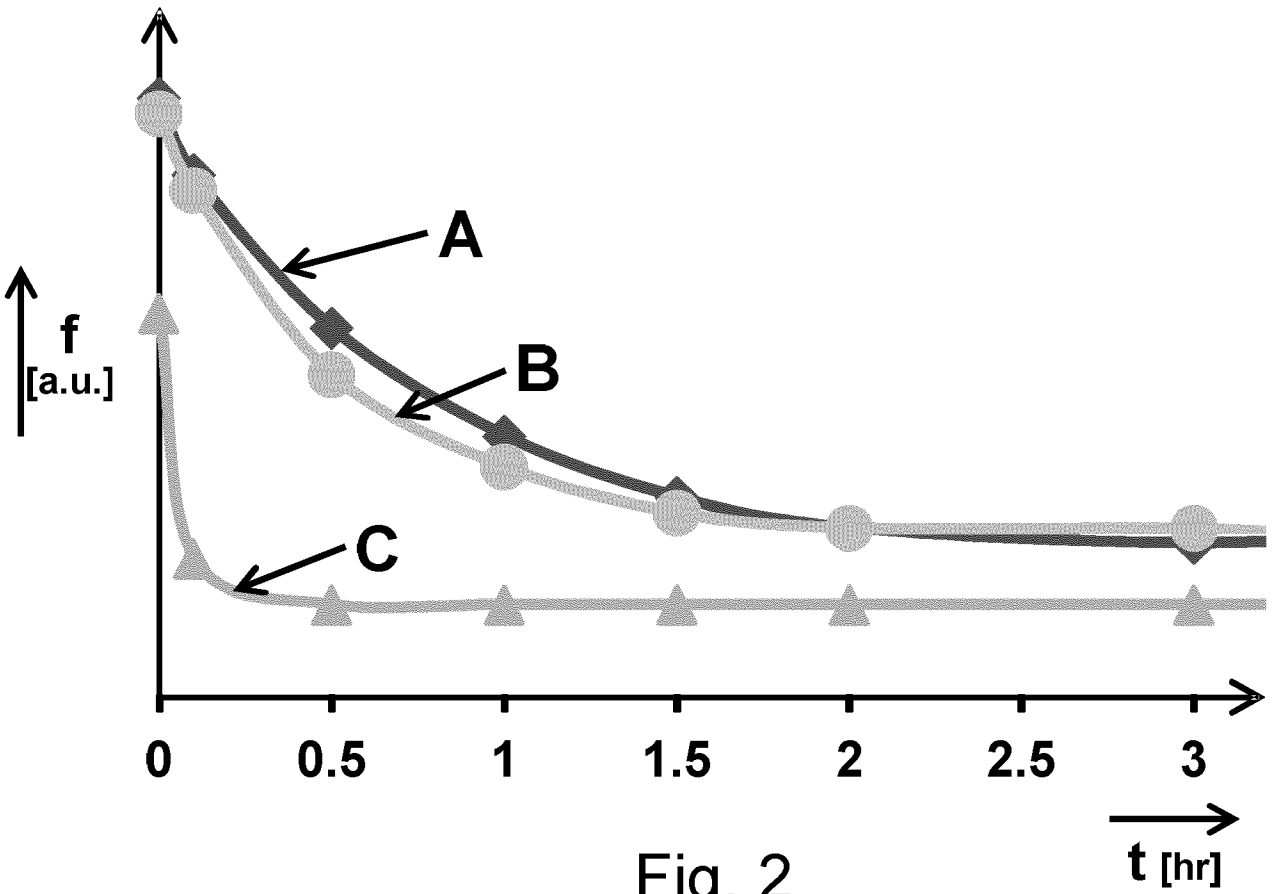
FIG. 2 is a diagram showing the gliding behavior over the ironing time of different contact surfaces.

Referring to FIG. 2, there is shown the coefficient of friction f (vertical axis, in arbitrary units) as a function of the ironing time t (horizontal axis, in hours), by using an iron having a contact surface provided with either a titanium oxide layer (curve C), a manganese oxide layer (curve B), or without an extra (outer) layer (curve A), on cotton. The favorable effect of the contact layer provided with a titanium oxide layer (curve C) is clearly shown: the contact surface with titanium oxide layer not only stabilizes faster, but also stabilizes at a lower coefficient of friction. This delivers better and more consistent gliding behavior. It was found that this effect is present by using metal oxide layers from certain early transition metals, while late transition metals (e.g. Mn) do not show such effect.

Figure 3:
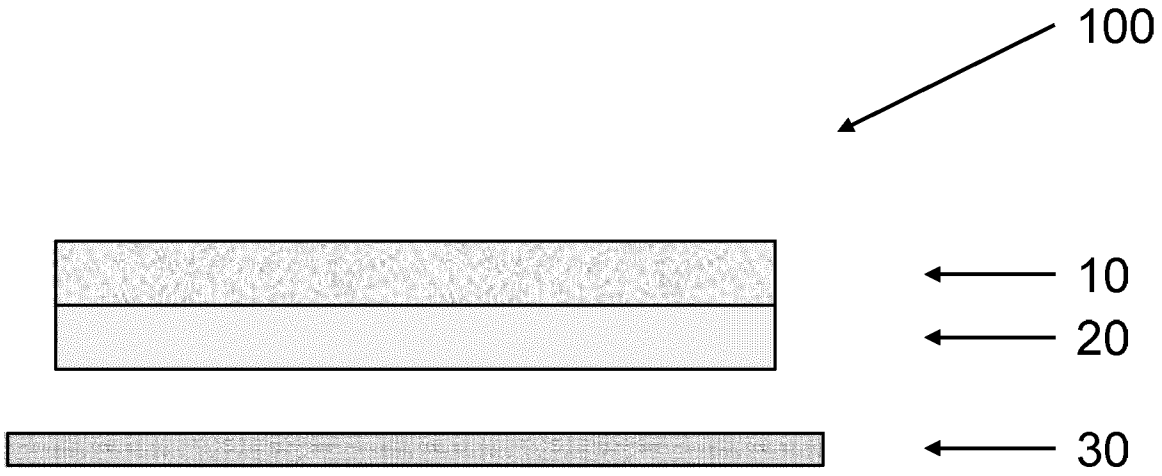
FIG. 3 is a drawing showing schematically the structure of a garment treatment plate and the positioning of the article to be treated.

Referring to FIG. 3, there is schematically shown the structure of a garment treatment plate 10 with a contact surface for a garment treatment appliance 100. The treatment plate is provided with a coating 20, which will come into contact with the article 30 (consisting of a fabric) to be treated. Hence, in effect the contact surface of the garment appliance is now the surface of the coating 20 most remote from the treatment plate. During use, said coating 20 may slide on the garment being treated.

The manufacture of the present metal oxide comprising coating of the contact surface of a garment treatment appliance will be explained below.

In order to achieve good and consistent gliding behavior, a thin-layer of a metal oxide film is applied on a base layer (sol-gel layer), via a sol-gel process. The metal oxide outer layer comprises at least an oxide of titanium, zirconium, hafnium, scandium or yttrium or mixtures thereof. The metal oxide layer is applied by means of the sol-gel process by using metal alkoxide precursors, which are preferably selected from metal alkoxide precursors such as a propoxide, isopropoxide, butoxide or derivatives thereof modified with acetylaceton or ethylacetoacetate. It will nevertheless be obvious that other salts which can be converted into an oxide form under the applied conditions can be used as well.

The metal alkoxide precursors preferably used in the process of the invention are selected from titanium (IV) propoxide, titanium (IV) isopropoxide, zirconium (IV) propoxide, hafnium (IV) propoxide, scandium (III) acetylacetonate. For yttrium, yttrium (III) acetate is a suitable starting material. The solvent used for preparing the precursor solution is expediently a lower alcohol, such as ethanol, isopropyl alcohol, 2-butanol, or 2-butoxy ethanol.

A coating preparation procedure for the present invention is described in the following; Ti, Zr and Y are used as examples.

Procedure:

- Mix M(i-OPr)4 (i.e. metal iso-propoxide) with ethyl acetoacetate (EAA) in a molar ratio of 1:1 and stir for 1 hour (preferably M=Ti or Zr)
- Dilute the precursors with isopropyl alcohol to a concentration of 0.1% to 80%, preferably 0.5-40% before use.

The concentration of precursors used can range from 0.1% to 80%, depending on the thickness required, preferably 0.5-40%. After the base layer (also called internal sol-gel coating) is sprayed and dried, the precursor solution is sprayed on top of said layer (internal sol-gel coating). After being dried and cured at a temperature of less than 400° C., the metal oxide outer layer is formed on top of the base layer (internal sol-gel layer). Depending upon the amount of solution sprayed on the base layer, the thickness of the external layer will range from 1 to 1000 nanometers; it will more preferably range from 5 nanometers to 400 nanometers for good appearance, gliding behavior and mechanical properties.

For yttrium, a procedure is as follows:

0.5 gr $Y(Ac)_3$ is dispersed in 25 ml of 2-Butoxy-ethanol. Then 0.38 gr acetylaceton(2eq) is added together with 0.26 gr$NH_3$(25%)(2eq) giving a clear solution.

The resulting solution can be applied as described for the titanium and zirconium oxide.

Mixtures of metal oxide can also be used. For example, yttrium zirconate or yttrium titanate has been observed to give good gliding layers.

For example, $Y_2Ti_3O_9$ is formed by mixing the yttrium complex from the preceding example with $Ti(OPr)_3$EAA in a ratio of 2 to 3 and applying the resulting solution as described for the pure Ti or Zr oxide layer.

A few examples of further systems that were prepared are:

- $TiPO_x$ was made by mixing 0.5 gr $Ti(OPr)_4$ with 0.47 tributylphosphate in 25 ml BuOH. The resulting solution can be applied as described for the titanium and zirconium oxide;
- $ZrPO_x$ was made by mixing 0.5 gr $Zr(OPr)_4$ with 0.28 tributylphosphate in 25 ml BuOH. The resulting solution can be applied as described for the titanium and zirconium oxide.

$TiPO_x$ or $ZrPO_x$ indicate a titanium phosphate or zirconium phosphate, respectively.

Besides the sol-gel process, the metal oxide layer can also be applied by another process such as PVD, CVD, or thermal spraying.

The coefficient of friction of the sol-gel coating with outer metal oxide layer (here $TiO_2$ is used as example) is measured following IEC standard [IEC standard for gliding & smoothness test IEC60311(ED4.1)]; a base layer (sol-gel layer) was also tested as a reference. The coefficient of friction of the coating with outer metal oxide layer on fabrics, e.g. cotton, synthetic, linen and silk etc., is consistently a very low value. FIG. 2 shows, as an example, the gliding behavior over ironing time of the coating with outer metal oxide layer on cotton. As compared with the reference base layer (sol-gel coating), the gliding behavior of the base layer with outer metal oxide ($TiO_2$) according to the invention is better and more consistent over time of usage.

Further, the gliding behavior of a number of materials was evaluated. This was on the one hand done based on theoretical evaluations and on the other hand done by experimental work, wherein a panel tests irons having the below indicated coatings, respectively, and compares the gliding behavior amongst the different coatings (Table 1):

TABLE 1

Gliding behavior of a number of coatings:

| Material (prepared via sol-gel synthesis) | Gliding behavior |
|---|---|
| Y2O3 | +++ |
| ZrO2 | +++ |
| La2O3 | + |
| TiO2 | +++ |
| MnOx | – |
| CoOx | – |
| VOx | – |
| Ti3(VO4)4 | –/+ |
| TiPOx | – |
| ZrPOx | – |
| Ce2O3 | – |
| Al2O3 | – |

From the above table, it is clear that the oxides of the invention have much better gliding properties than other oxides or phosphates or vanadates, etc.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims as can be understood and effected by those skilled in the art, from a study of the drawings, the disclosure, and the appended claims. In the claims, the word "comprising" does not exclude other elements or steps, and the indefinite article "a" or "an" does not exclude a plurality. Even if certain features are recited in different dependent claims, the present invention also relates to an embodiment comprising these features in common. Any reference signs in the claims should not be construed as limiting the scope.

The invention claimed is:

1. A treatment plate for a garment treatment appliance, which treatment plate has a contact surface that in use slides on a garment being treated, wherein said contact surface is provided with a coating that comprises a metal oxide selected from the group consisting of titanium oxide, zirconium oxide, yttrium oxide, hafnium oxide, scandium oxide, or a mixture or combination thereof, wherein said coating has a thickness of less than 400 nm.

2. A treatment plate according to claim 1, wherein the coating is a sol-gel coating.

3. A treatment plate according to claim 1, wherein said coating substantially consists of one of: titanium oxide, zirconium oxide, a mixture or combination of titanium oxide and zirconium oxide, a mixture or combination of titanium oxide and yttrium oxide.

4. A treatment plate according to claim 1 wherein the treatment plate comprises a metal substrate and wherein the treatment plate further comprises at least one layer arranged between said metal substrate and said coating, said layer being a metal composition, an enamel, organic polymer, organo-silicate or silicate layer.

5. A method to produce a coating on a contact surface of a treatment plate for a garment treatment appliance, wherein, in use, said contact surface slides on a garment being treated, the method comprising the steps of:

depositing on said contact surface a layer of a precursor material of a metal or compound, selected from titanium, zirconium, hafnium, scandium, yttrium, or a mixture or combination of these metals or compounds, wherein the precursor material comprises one or more of a hydrolysable precursor and a hydrolysable precursor solution;

treating said layer to obtain a layer comprising titanium oxide, zirconium oxide, hafnium oxide, scandium oxide, yttrium oxide, or a mixture or combination thereof, depositing on said contact surface a layer of a hydrolysable precursor, preferably an alkoxide precursor or an acetate precursor, of a metal, selected from titanium, zirconium, hafnium, scandium, yttrium, or a mixture or combination of these metals or compounds; and curing said layer to obtain a layer comprising titanium oxide, zirconium oxide, hafnium oxide, scandium oxide, yttrium oxide, or a mixture or combination thereof.

6. A method according to claim 5, wherein said deposition is by means of a dry chemical process, preferably a vapour deposition process.

7. A method according to claim 5, the method comprising the steps of:

preparing a hydrolysable precursor solution, preferably of an alkoxide precursor or an acetate precursor, of a metal, selected from titanium, zirconium, hafnium, scandium, yttrium, or a mixture or combination of these metals or metal compounds, depositing on said contact surface a layer of said precursor solution, followed by drying, if necessary, and curing, to obtain a layer comprising titanium oxide, zirconium oxide, hafnium oxide, scandium oxide, yttrium oxide, or a mixture or combination thereof.

8. A method according to claim 7, wherein said deposition is by means of a wet chemical process, preferably a solution process, more preferably a sol-gel process.

9. A method according to claim 7, wherein the solvent used for preparing the solution of an alkoxide or acetate precursor of said metal is a lower alcohol, preferably ethanol, isopropylalcohol, 2-butanol, or 2-butoxy-ethanol.

10. A method according to claim 7, wherein said alkoxide or acetate precursor is a propanolate or acetylacetonate derivative, and wherein said drying and curing is effected at a temperature below 400° C.

11. A method according to claim 5, wherein said contact surface of the treatment plate consists of a metal, enamel, organic polymer, organo-silicate, or silicate composition.

12. A method according to claim 5, wherein said contact surface is precoated with at least one layer, preferably consisting of a metal composition, enamel, organic polymer, organo-silicate or silicate, more preferably a metal oxide layer prepared by sol-gel techniques.

13. A garment treatment appliance including a treatment plate according to claim 1.

* * * * *